US006929191B2

(12) United States Patent
Kim

(10) Patent No.: US 6,929,191 B2
(45) Date of Patent: Aug. 16, 2005

(54) STRAW

(76) Inventor: Jong In Kim, 15-802 Asiaseonsuchon Apartment 86 Jamshil 7dong, Songpaku, Seoul (KR)

( * ) Notice: Subject to any disclaimer, the term of this patent is extended or adjusted under 35 U.S.C. 154(b) by 7 days.

(21) Appl. No.: 10/770,036

(22) Filed: Feb. 2, 2004

(65) Prior Publication Data

US 2004/0195347 A1 Oct. 7, 2004

(30) Foreign Application Priority Data

Mar. 14, 2003 (KR) ..... 10-2003-0016047

(51) Int. Cl.[7] ..... A47G 21/18; E03B 9/20
(52) U.S. Cl. ..... 239/33; 239/16; 239/29.3
(58) Field of Search ..... 239/33, 16, 24, 239/26, 27, 29.3

(56) References Cited

U.S. PATENT DOCUMENTS 3,972,326 A * 8/1976 Brawn ..... 128/202.15
5,045,195 A * 9/1991 Spangrud et al. ..... 210/266
5,184,774 A * 2/1993 Lipson ..... 239/33
5,236,415 A * 8/1993 Stallings ..... 604/514
5,520,304 A * 5/1996 Lin ..... 220/707

* cited by examiner

*Primary Examiner*—Davis Hwu
(74) *Attorney, Agent, or Firm*—Anderson Kill & Olick, PC

(57) ABSTRACT

Disclosed is a straw for giving a new sucking feeling to users by squirting fluid liquid-phase beverages, such as milk, juice, coffee, carbon beverage, and so on, to the whole inside of the user's mouth when the user sucks up the liquid-phase beverages. The straw comprising: a tubular body having the intake passage formed therein; at least two or more squirt holes formed on the outer peripheral surface of the tubular body in such a manner as to be adjacent to one side end of the tubular body, and adapted to squirt the fluid liquid-phase beverages sucked up through the intake passage in all directions, the squirt holes communicating with the intake passage; and blocking shields bent downwardly from the upper portions of the squirt holes toward the inside center of the intake passage, when the squirt holes are formed, for blocking a part of the intake passage. The squirt holes allow the fluid liquid-phase beverage sucked to be squirted and spread into the whole inside of the user's mouth through the intake passage.

3 Claims, 10 Drawing Sheets

【Fig: 1】
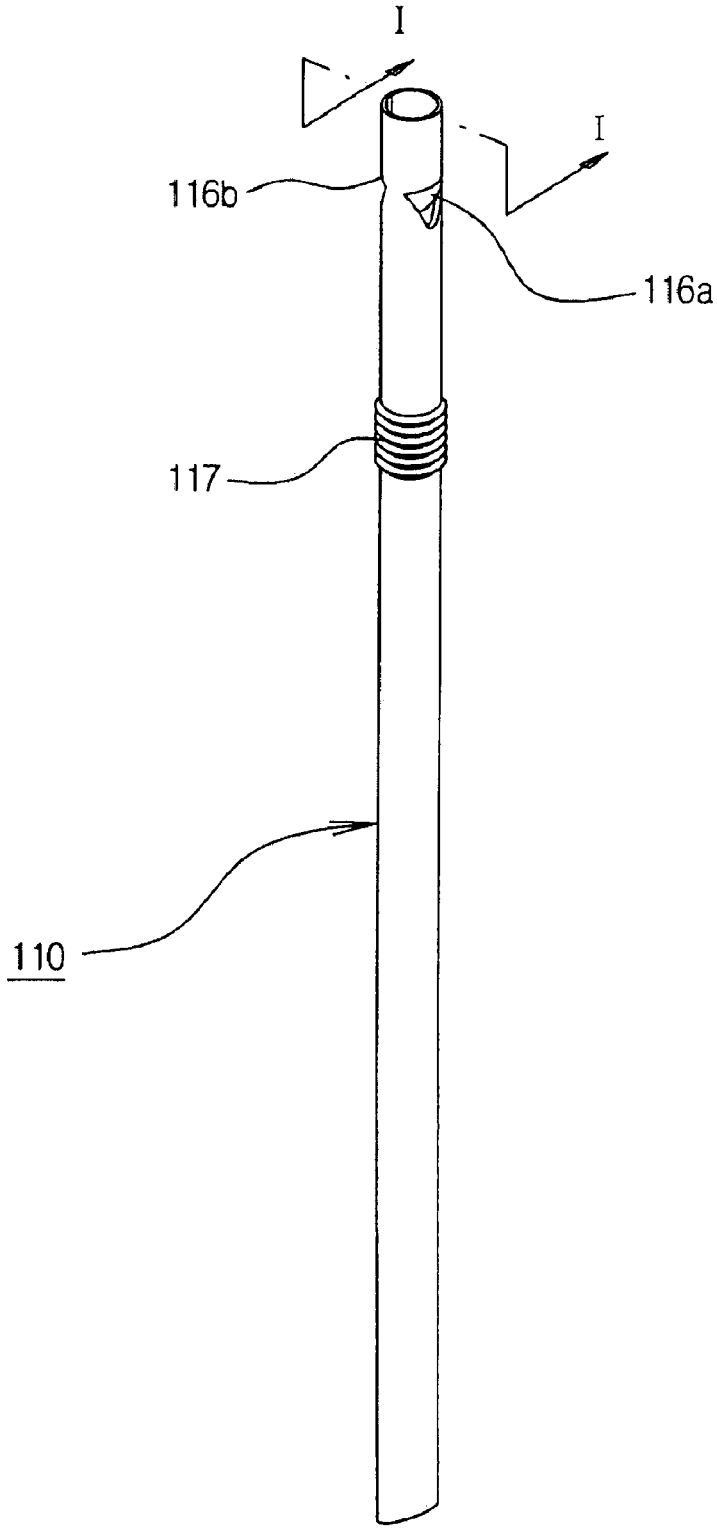

【Fig. 2】
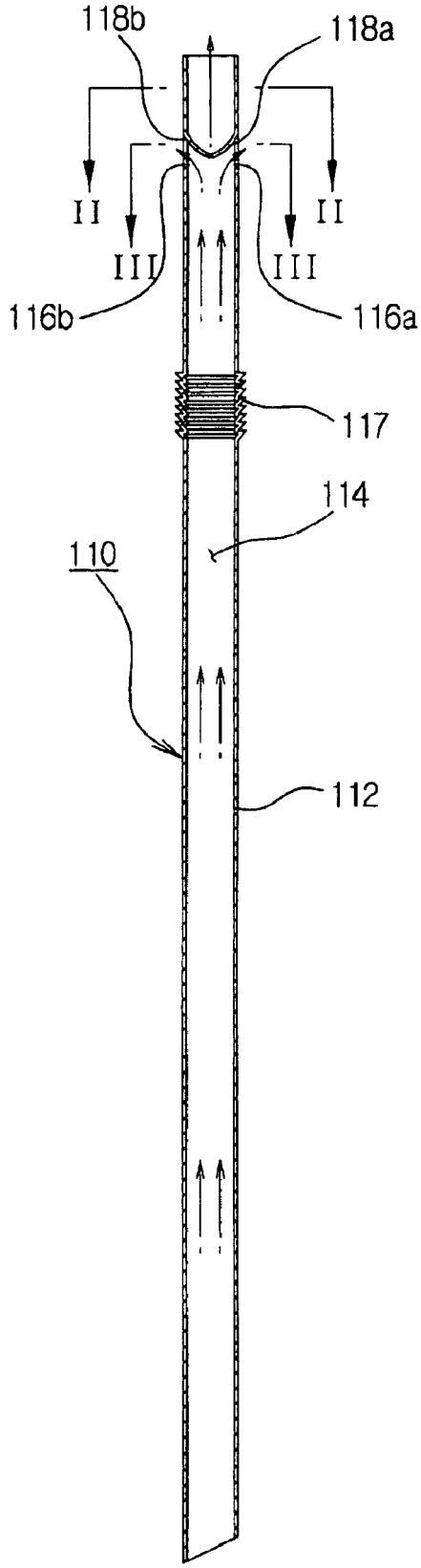

【Fig. 3】
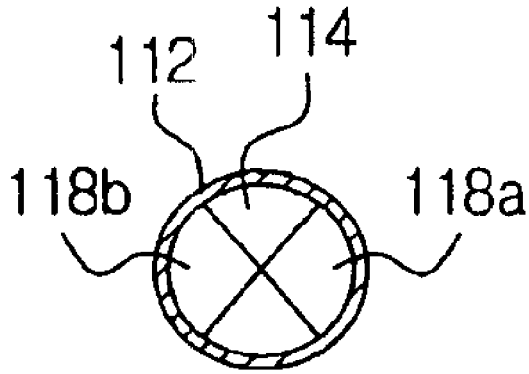
【Fig. 4】
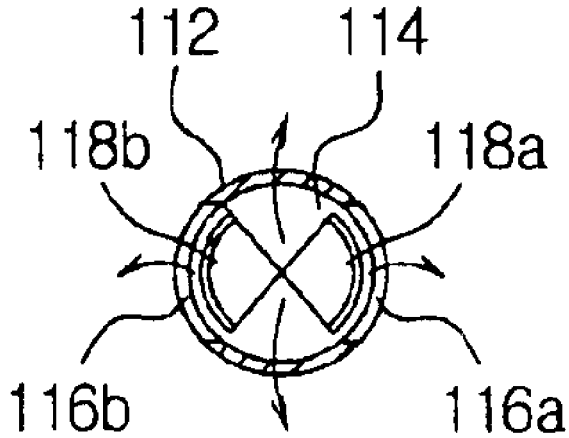

[Fig. 5]
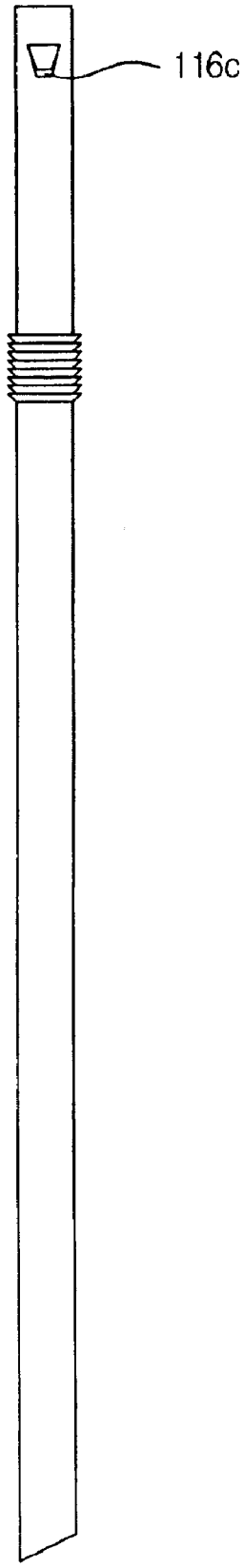

【Fig. 6】
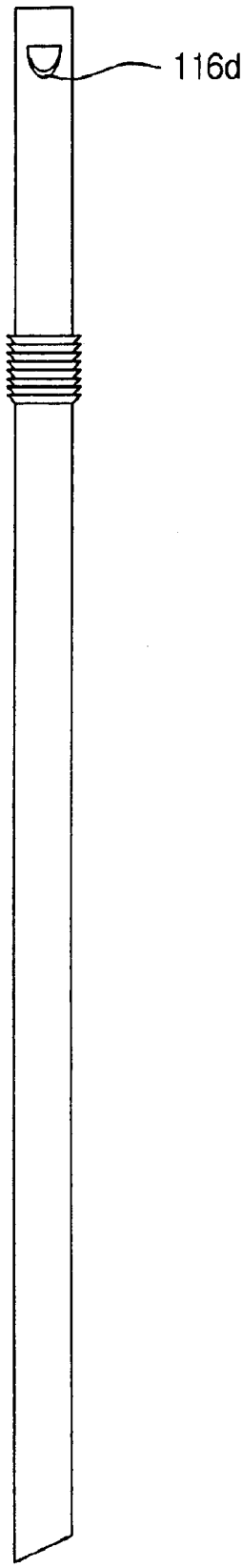

【Fig. 7】
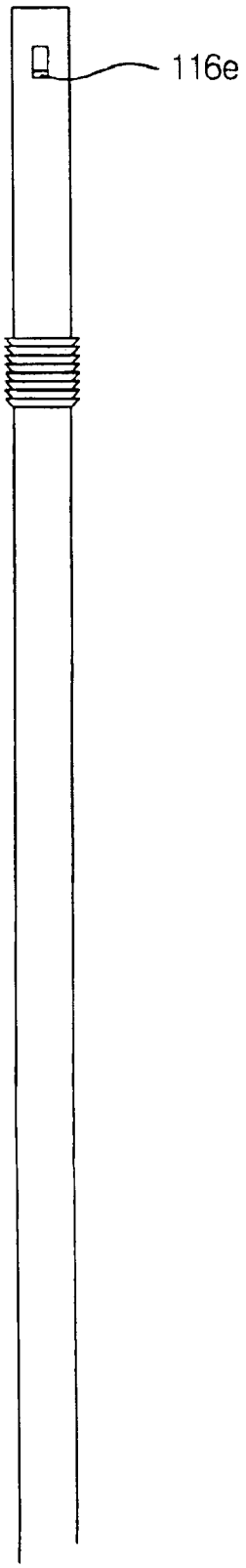

【Fig. 8】
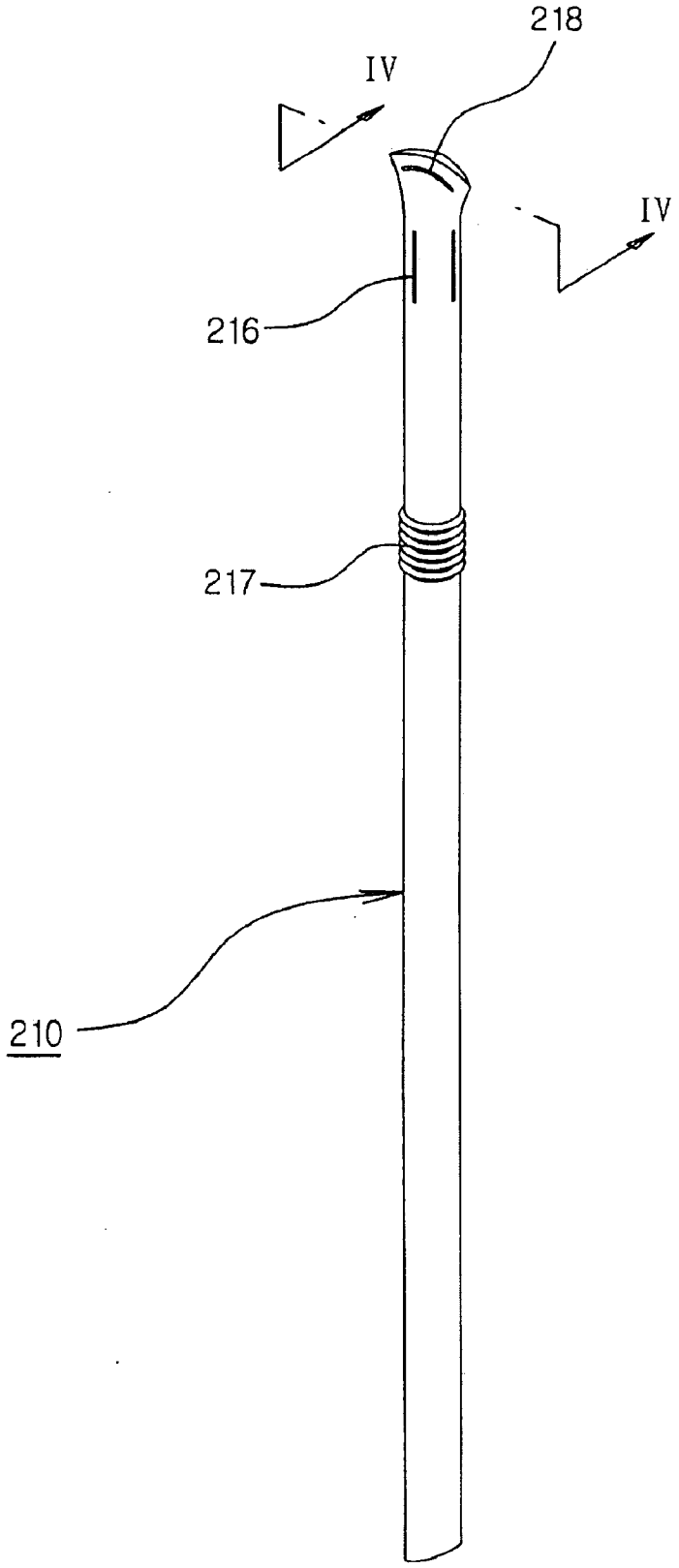

【Fig. 9】
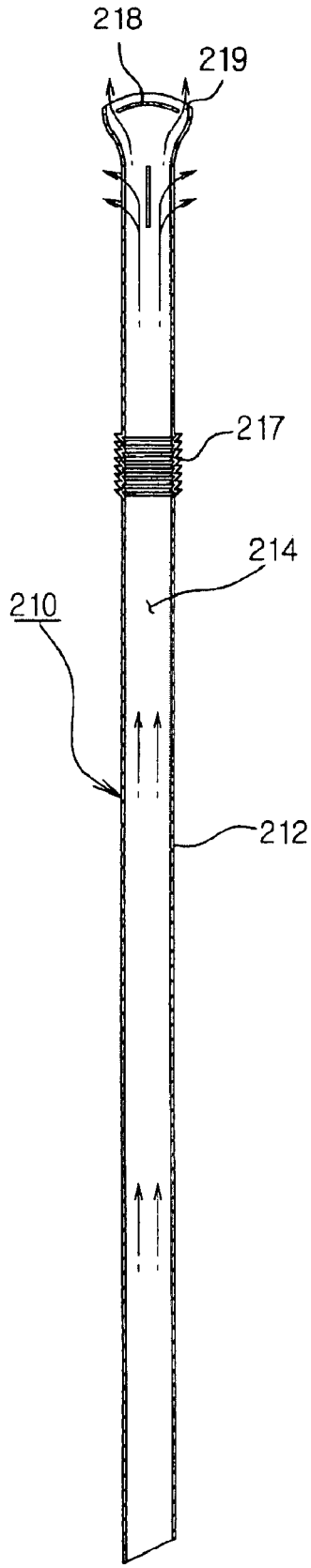

【Fig. 10】
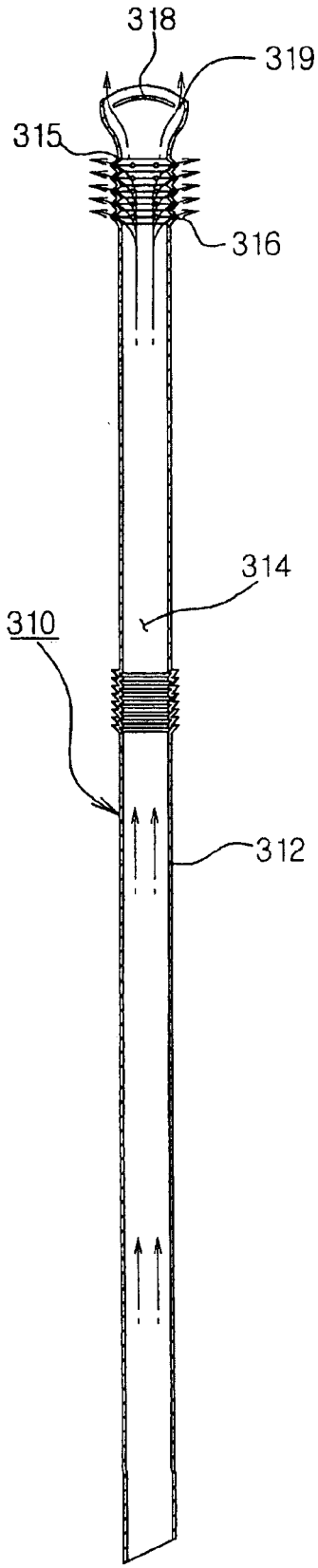

【Fig. 11】
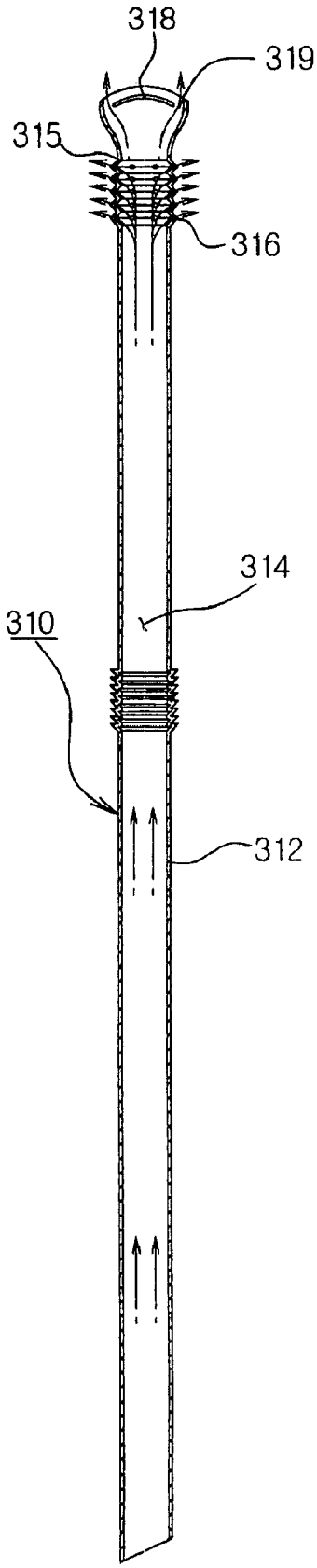

STRAW

BACKGROUND OF THE INVENTION

1. Field of the Invention

The present invention relates to a straw used for sucking up a fluid liquid phase beverage, and more particularly, to a straw, which has at least two or more squirt holes formed on the outer peripheral surface of the tubular body to be adjacent to an end of the tubular body.

2. Background of the Related Art

In general, a straw used for sucking a fluid liquid phase beverage allows a user to suck up the liquid phase beverage through an intake passage of a large diameter formed along the inside of a straw tubular body.

However, as described above, because the conventional straw allows the user to suck the liquid phase beverage through the intake passage, the sucked liquid phase beverage is directly squirted from the intake passage of the straw to the user's throat, and so, he or she often swallows the wrong way as the directly squirted beverage stops the user's throat in a moment. Particularly, children more frequently experience it than adults do, and, in this case, the user suffers from an inconvenience of vomiting out what he or she has drunken.

Furthermore, the conventional straw designed to squirt the beverage only in a straight line cannot give other feelings to the user except the drinking while the user sucks up the liquid phase beverage.

SUMMARY OF THE INVENTION

Accordingly, the present invention is directed to a straw that substantially obviates one or more problems due to limitations and disadvantages of the related art.

An object of the present invention is to provide a straw, which allows liquid phase beverage sucked up through a straw tubular body to be squirted to the whole inside of the user's mouth, thereby giving a user a sort of tickling and pungent feeling and providing pleasures to the user's whole body while the user tastes a taste with the whole inside of the user's mouth.

To achieve the above object, according to one aspect of the present invention, there is provided a straw having an intake passage for sucking up fluid liquid-phase beverages, such as coffee, milk, carbon beverage, drink, etc., therethrough, including: a tubular body having the intake passage formed therein; at least two or more squirt holes formed on the outer peripheral surface of the tubular body in such a manner as to be adjacent to one side end of the tubular body, and adapted to squirt the fluid liquid-phase beverages sucked up through the intake passage in all directions, the squirt holes communicating with the intake passage; and blocking shields bent downwardly from the upper portions of the squirt holes toward the inside center of the intake passage, when the squirt holes are formed, for blocking a part of the intake passage It is preferable that the squirt holes are formed in various forms or shapes to have different sizes.

Furthermore, it is preferable that the tubular body further includes a corrugated part.

According to another aspect of the present invention, there is also provided a straw having an intake passage for sucking up a fluid liquid phase beverage therethrough, including: a tubular body having the intake passage formed therein, the tubular body having a closed end portion; and at least two or more squirt holes formed on the outer peripheral surface of the tubular body in such a manner as to be adjacent to the closed end portion of the tubular body, and adapted to squirt the fluid liquid phase beverage sucked up through the intake passage in all directions, the squirt holes communicating with the intake passage.

It is preferable that the squirt holes are elongated holes of a slit type formed along the longitudinal direction of the tubular body, the elongated holes having different widths, lengths and positions.

Moreover, it is preferable that the closed end portion has small holes smaller in diameter than the squirt holes.

According to another aspect of the present invention, there is provided a straw, which has an intake passage for sucking up a fluid liquid phase beverage, including: a tubular body having the intake passage formed therein, the tubular body having a closed end portion; a corrugated part formed on the outer peripheral surface of the tubular body in such a manner as to be adjacent to the closed end portion; and at least two or more squirt holes formed on the corrugated part, and adapted to squirt the fluid liquid phase beverage sucked up through the intake passage in all directions, the squirt holes communicating with the intake passage.

It is preferable that the closed end portion includes small holes smaller in diameter than the squirt holes.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 1 is a perspective view of a straw according to a first preferred embodiment of the present device;

FIG. 2 is an enlarged vertically sectional view taken along the line of I—I of FIG. 1;

FIG. 3 is an enlarged plan-sectional view taken along the line of II—II of FIG. 2;

FIG. 4 is an enlarged plan-sectional view taken along the line of III—III of FIG. 2;

FIGS. 5 to 7 are front views of modifications of squirt holes of the straw of FIG. 1;

FIG. 8 is a perspective view of a straw according to a second preferred embodiment of the present device;

FIG. 9 is an enlarged plan-sectional view taken along the line of IV—IV of FIG. 8;

FIG. 10 is a perspective view of a straw according to a third preferred embodiment of the present device; and, FIG. 11 is an enlarged vertically sectional view taken along the line of V—V of FIG. 10.

DETAILED DESCRIPTION OF THE PREFERRED EMBODIMENT

Reference will now be made in detail to the preferred embodiments of the present invention, examples of which are illustrated in the accompanying drawings.

FIG. 1 is a perspective view of a straw according to a first preferred embodiment of the present device, FIG. 2 is an enlarged vertically sectional view taken along the line of I—I of FIG. 1, FIG. 3 is an enlarged plan-sectional view taken along the line of II—II of FIG. 2, and FIG. 4 is an enlarged plan-sectional view taken along the line of III—III of FIG. 2.

As shown in the drawings, the straw 110 according to the present device includes a hollow rounded tubular body 112 having an intake passage 114 formed therein.

The tubular body 112 has squirt holes 116*a* and 116*b* of an approximately triangular shape oppositely formed on the outer peripheral surface of an intake portion, which will be inserted into a user's mouth later, at a predetermined interval. At this time, the squirt holes 116*a* and 116*b* communicate with the intake passage 114. The squirt holes 116*a* and 116*b* are made by a general compression and cutting process, which is carried out after molding of the straw 110.

The squirt holes 116*a* and 116*b* respectively have blocking shields 118*a* and 118*b* for blocking a part of the intake passage 114. The blocking shields 118*a* and 118*b* are fragments of the tubular body 112 generated when the squirt holes 116*a* and 116*b* are formed. As shown in FIG. 2, the blocking shields 118*a* and 118*b* are bended downwardly from the upper portion of the squirt holes 116*a* and 116*b* toward the inside center of the intake passage 112 so as to block a part of the intake passage 112. The blocking shields 118*a* and 118*b* act as resistant bodies for stopping a part of a fluid liquid-phase beverage flowing through the intake passage 114, and a part of the liquid-phase beverage sucked up through the intake passage 114 is squirted through the squirt holes 116*a* and 116*b*.

That is, when the user takes the intake portion of the straw 110 having the squirt holes 116*a* and 116*b*, to his or her lips and sucks up the liquid-phase beverage, the liquid-phase beverage is squirted into the user's mouth through an opening of the upper portion of the straw along the intake passage 114.

However, as indicated by an arrow of FIG. 2, the moment the liquid-phase beverage flowing along the intake passage 114 passes through a region where the blocking shields 118*a* and 118*b* are formed, the liquid-phase beverage collides against the blocking shields 118*a* and 118*b*, and hence receives resistance in its flow. As shown in FIG. 2, as the blocking shields 118*a* and 118*b* block about ½ of the area of the intake passage 114, a part of the flowing liquid-phase beverage is stopped and encounter fluid resistance by means of the blocking shields 118*a* ad 118*b*. At this time, the liquid-phase beverage is rapidly squirted into the user's mouth through the squirt holes 116*a* and 116*b* like a fountain.

The squirted liquid-phase beverage is equally spread to the whole inside of the user's mouth. The moment the liquid-phase beverage touches the inside of the user's mouth, he or she gets pleasures along with a tickling and pungent feeling, and a gradually different taste while tasting a taste through the whole inside of the user's mouth by the liquid-phase beverage spreading to the whole inside of the user's mouth. It gives the user a very unique feeling, which cannot be obtained by the conventional straws. The above-mentioned facts have been found through a result of several people's having used the straws of the present invention.

It is preferable that the squirt holes 116*a* and 116*b* have the size as large as they do not prevent squirt of the liquid-phase beverage. Moreover, although the number of the squirt holes 116*a* and 116*b* is two in the drawings, it will be appreciated that the number of the squirt holes 116*a* and 116*b* may be four or more. However, it is preferable that the number of the squirt holes 116*a* and 116*b* is within a range in which the squirt holes do not affect the strength of the straw.

Additionally, in the present embodiment, the straw 110, which has the squirt holes 116*a* and 116*b*, includes a corrugated part 117. However, the squirt holes 116*a* and 116*b* may be applied to any straws without the corrugated part.

FIGS. 5 to 7 are front views of modifications of the squirt holes 116*a* and 11*b* of FIG. 1.

FIG. 5 shows a squirt hole 116*c* being in the form of a trapezoid, FIG. 6 shows a squirt hole 116*d* being in the form of a semicircle, and FIG. 7 shows a squirt hole 116*e* being in the form of a rectangle. Of course, the squirt holes 116*a* and 116*b* can be formed in any other shapes beside the above shapes. The structure and function of the squirt holes are the same as the first embodiment.

FIG. 8 is a perspective view of a straw according to a second preferred embodiment of the present device, and FIG. 9 is an enlarged plan-sectional view taken along the line of IV—IV of FIG. 8.

As shown in the drawings, the straw 210 according to the present device includes a hollow rounded tubular body 212 having a flat type closed end portion 218 formed at an end of the straw 210, which is inserted into the user's mouth, and an intake passage 214 formed inside the tubular body 212 for allowing the user to suck up a fluid liquid-phase beverage.

The tubular body 212 further has at least two or more squirt holes 216 of an elongated hole type formed at an adjacent portion of the closed end portion 218, more exactly, only on the outer peripheral surface of an intake part thereof, which is inserted into the user's mouth, at regular intervals, the squirt holes 216 communicating with the intake passage 214. As in the first preferred embodiment, the squirt holes 216 are formed to squirt the liquid-phase beverage like a fountain the moment the liquid-phase beverage sucked up through the intake passage 214 of the straw 210 passes through the squirt holes 216 when the user takes the closed end portion 218 of the straw 210 to the user's lips and sucks up the liquid-phase beverage.

Since there are used only the squirt holes 216 of a slit type as opened parts formed at the intake part of the straw 110, the user's sucking power is exerted only to the squirt holes 216 from the intake passage 214, and hence, the liquid-phase beverage sucked up through the intake passage 214 is discharged to the outside only through the squirt holes 216.

However, as the squirt holes 216 are formed along the outer peripheral of the tubular body 212 at regular intervals, the moment the sucked liquid-phase beverage passes through the squirt holes 216, as shown in FIG. 9, the liquid-phase beverage is spread to the whole inside of the user's mouth evenly while being squirted finely like a fountain. The moment the liquid-phase beverage squirted finely through the squirt holes 216 touches the inside of the user's mouth, as in the first preferred embodiment, the user can have a taste of the liquid-phase beverage and be given a sort of tickling and pungent feeling by the fine spout of water.

For this reason, it is preferable that the squirt holes 216 formed in the tubular body 212 has a small diameter or width. So, as shown in FIGS. 8 and 9, the squirt holes 216 have the slit structure formed finely and long in a longitudinal direction of the tubular body 212 and at regular intervals along the outer peripheral surface of the tubular body 212. Moreover, it is preferable the squirt holes 216 of the slit type are not excessively long, but it is located in the user's mouth.

The number of the squirt holes 216 is two or more, but it is preferable that the number of the squirt holes 216 is selected in consideration of strength of the tubular body 212. Furthermore, the squirt holes 216 can be formed at any positions if they are located only at the intake part, which is inserted into the user's mouth.

The closed end portion 218 can have small holes 219 smaller than or equal to the squirt holes 216 in diameter. The reason of this is to give a unique feeling to the user by squirting the liquid-phase beverage through the closed end portion 218 when the user sucks up the liquid-phase beverage with the straw 210.

Additionally, in this embodiment, the straw 210, which has the squirt holes 216 of the slit type, includes a corrugated part 217. However, the squirt holes 216 can be applied to any straws without the corrugated part.

FIG. 10 is a perspective view of a straw according to a third preferred embodiment of the present device, and FIG. 11 is an enlarged vertically sectional view taken along the line of V—V of FIG. 10.

In the third preferred embodiment, as in the second preferred embodiment, the straw 310 according to the present device includes a hollow rounded tubular body 312 having an intake passage 314, which has a closed end portion 318.

The tubular body 312 has a corrugated part 315 formed at a position adjacent to the closed end portion 318, that is, at the outer peripheral surface of an intake part of the straw 310, which is inserted into the user's mouth, and a number of squirt holes 316 formed along the corrugated part 315 at regular intervals, the squirt holes 316 communicating with the intake passage 314. The bent portions of the corrugated part 315 acts as a resistant body against the liquid-phase beverage flowing through the intake passage 314 to facilitate the squirt of the liquid-phase beverage through the squirt holes 316.

As in the second preferred embodiment, as the intake passage 314 is blocked by the closed end portion 318, the liquid-phase beverage sucked up through the intake passage 314 is spread and squirted to the whole inside of the user's mouth only through the squirt holes 316, which are opened to the outside. The user can be given the same feeling as the first and second preferred embodiments.

As described in the second preferred embodiment, at both ends of the closed end portion 318 are formed small holes 319 which are smaller than or equal to the squirt holes 316 in diameter.

Also in the third preferred embodiment, the squirt holes 316 are formed in the straw 310, which has the corrugated part 317, but it will be appreciated that the squirt holes 316 can be formed in any straw without the corrugated part 317.

As described above, the straw according to the present invention squirts the liquid-phase beverage through the squirt holes formed in the tubular body of the straw, to the whole inside of the user's mouth, thereby giving a user a sort of tickling and pungent feeling and providing the pleasure to the user's whole body while he or she tastes a taste through the whole inside of the user's mouth.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A straw having an intake passage for sucking up fluid liquid-phase beverages, such as coffee, milk, carbon beverage, drink, etc., therethrough, comprising:

a tubular body having the intake passage formed therein;

at least two or more squirt holes formed on the outer peripheral surface of the tubular body in such a manner as to be adjacent to one side end of the tubular body, and adapted to squirt the fluid liquid-phase beverages sucked up through the intake passage in all directions, the squirt holes communicating with the intake passage; and blocking shields bent downwardly from the upper portions of the squirt holes toward the inside center of the intake passage, when the squirt holes are formed, for blocking a part of the intake passage.

2. The straw according to claim 1, wherein the squirt holes are formed in various forms or shapes to have different sizes.

3. The straw according to claim 1, wherein the tubular body further includes a corrugated part.

* * * * *